US008056750B2

(12) United States Patent
Vovan

(10) Patent No.: US 8,056,750 B2
(45) Date of Patent: Nov. 15, 2011

(54) ADVANCED TAMPER EVIDENT BOWL

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 1021 days.

(21) Appl. No.: 11/879,168

(22) Filed: Jul. 16, 2007

(65) Prior Publication Data

US 2008/0006632 A1 Jan. 10, 2008

Related U.S. Application Data

(63) Continuation-in-part of application No. 11/315,654, filed on Dec. 21, 2005.

(51) Int. Cl.
*B65D 17/347* (2006.01)
*B65D 17/353* (2006.01)

(52) U.S. Cl. ..... 220/270; 220/266; 220/268; 220/791

(58) Field of Classification Search ..... 220/270, 220/266, 268, 791
See application file for complete search history.

(56) References Cited

U.S. PATENT DOCUMENTS

| | | | | | |
|---|---|---|---|---|---|
| 1,988,280 | A | | 1/1935 | Levkoff | |
| 2,701,053 | A | | 2/1955 | Tamarin | |
| 3,572,579 | A | | 3/1971 | Mueller | |
| 3,773,207 | A | * | 11/1973 | Dokoupil et al. | 220/270 |
| 3,860,148 | A | * | 1/1975 | Sherin | 222/153.06 |
| 3,933,296 | A | | 1/1976 | Ruskin et al. | |
| 3,984,025 | A | * | 10/1976 | Khoury | 220/270 |
| 4,113,136 | A | | 9/1978 | Abbott | |
| 4,139,121 | A | | 2/1979 | Roccaforte | |
| 4,569,443 | A | | 2/1986 | Roccaforte | |
| 4,610,371 | A | * | 9/1986 | Karkiewicz | 220/266 |
| 4,627,550 | A | | 12/1986 | Dines | |
| 4,742,935 | A | | 5/1988 | Schellenberg | |
| 4,782,977 | A | | 11/1988 | Watanabe et al. | |
| 4,819,824 | A | | 4/1989 | Longbottom et al. | |
| 4,974,735 | A | | 12/1990 | Newell | |
| 5,007,231 | A | | 4/1991 | Ingemann | |
| 5,040,695 | A | | 8/1991 | Adams et al. | |
| 5,052,572 | A | | 10/1991 | Pherigo | |
| 5,092,479 | A | * | 3/1992 | Wells | 220/4.23 |
| 5,131,551 | A | | 7/1992 | Wells | |

(Continued)

FOREIGN PATENT DOCUMENTS

DE 7816353 11/1978

(Continued)

OTHER PUBLICATIONS

U.S. Appl. No. 11/315,654, filed Dec. 21, 2005.

(Continued)

*Primary Examiner* — Mickey Yu
*Assistant Examiner* — Niki Eloshway
(74) *Attorney, Agent, or Firm* — Baker Botts L.L.P.

(57) ABSTRACT

A container with a base (12) and lid (14), clearly indicates if the lid has been opened after a clerk loaded food into the base and closed the lid. The base and lid each has a respective lid tab and a base tab, with one tab forming a slot (26) and the tab other projecting through the slot, and with the base tab forming a barrier wall (80) that lies over the lid tab. One of the tabs has a weakened severable line (90, 92) that can be torn to allow the lid tab to be lifted to open the container.

5 Claims, 7 Drawing Sheets

U.S. PATENT DOCUMENTS

| | | | | |
|---|---|---|---|---|
| 5,133,470 | A | 7/1992 | Abrams et al. | |
| 5,219,087 | A * | 6/1993 | Christensson | 220/270 |
| 5,249,694 | A | 10/1993 | Nelson | |
| 5,300,748 | A | 4/1994 | Colombo | |
| 5,507,406 | A | 4/1996 | Urciuoli | |
| 5,772,110 | A | 6/1998 | Garretson | |
| 5,788,105 | A * | 8/1998 | Foos | 220/266 |
| 5,871,147 | A | 2/1999 | Smith et al. | |
| 5,890,648 | A | 4/1999 | Cai | |
| 5,931,291 | A * | 8/1999 | Sedon et al. | 206/1.5 |
| 5,931,332 | A | 8/1999 | Mygatt et al. | |
| 6,045,038 | A | 4/2000 | Smith et al. | |
| 6,328,355 | B1 * | 12/2001 | Bortz | 292/307 R |
| 6,491,164 | B1 | 12/2002 | Virvo | |
| 6,572,909 | B1 | 6/2003 | Bagwell et al. | |
| 6,877,631 | B1 * | 4/2005 | Thompson et al. | 220/266 |
| 7,004,314 | B2 | 2/2006 | Pucillo et al. | |
| 7,073,680 | B2 * | 7/2006 | Boback et al. | 220/266 |
| 7,097,043 | B2 | 8/2006 | Hsu | |
| 7,118,003 | B2 | 10/2006 | Sellari | |
| 7,140,211 | B2 | 11/2006 | Tremblay | |
| 7,172,109 | B2 | 2/2007 | Kuentseler et al. | |
| 7,325,676 | B2 | 2/2008 | Galaz | |
| 7,661,547 | B2 | 2/2010 | Richir | |
| 2002/0088814 | A1 | 7/2002 | Belfance | |
| 2004/0108370 | A1 | 6/2004 | Lee | |
| 2004/0118848 | A1 | 6/2004 | Marshall | |
| 2004/0200891 | A1 | 10/2004 | Correll | |
| 2005/0017007 | A1 | 1/2005 | Sellari et al. | |
| 2005/0061861 | A1 | 3/2005 | Pennino | |
| 2005/0161455 | A1 * | 7/2005 | Studee | 220/266 |
| 2005/0173435 | A1 | 8/2005 | Wellman et al. | |
| 2005/0184070 | A1 | 8/2005 | Boback et al. | |
| 2006/0289541 | A1 | 12/2006 | Boback et al. | |
| 2006/0289549 | A1 | 12/2006 | Vovan | |
| 2007/0108210 | A1 | 5/2007 | Alvares et al. | |
| 2007/0138180 | A1 * | 6/2007 | Vovan | 220/266 |
| 2007/0202221 | A1 | 8/2007 | Hinze et al. | |
| 2008/0000904 | A1 | 1/2008 | Vovan | |
| 2008/0006632 | A1 | 1/2008 | Vovan | |
| 2009/0057313 | A1 | 3/2009 | Alvares | |

FOREIGN PATENT DOCUMENTS

| | | |
|---|---|---|
| EP | 1736417 | 12/2006 |
| FR | 2691952 | 12/1993 |
| FR | 2 819 496 | 7/2002 |
| WO | WO 2005/082733 | 9/2005 |

OTHER PUBLICATIONS

U.S. Appl. No. 11/857,144, filed Sep. 18, 2007.

U.S. Appl. No. 12/220,017, filed Jul. 21, 2008.

U.S. Appl. No. 11/315,654, Non-Final Rejection dated Nov. 25, 2009.

U.S. Appl. No. 11/315,654, Amendment dated Jan. 20, 2010.

U.S. Appl. No. 11/315,654, Supplemental Response dated Feb. 23, 2010.

U.S. Appl. No. 11/315,654, Restriction Requirement dated Jun. 25, 2010.

U.S. Appl. No. 11/315,654, Response to Restriction Requirement dated Jul. 26, 2010.

* cited by examiner

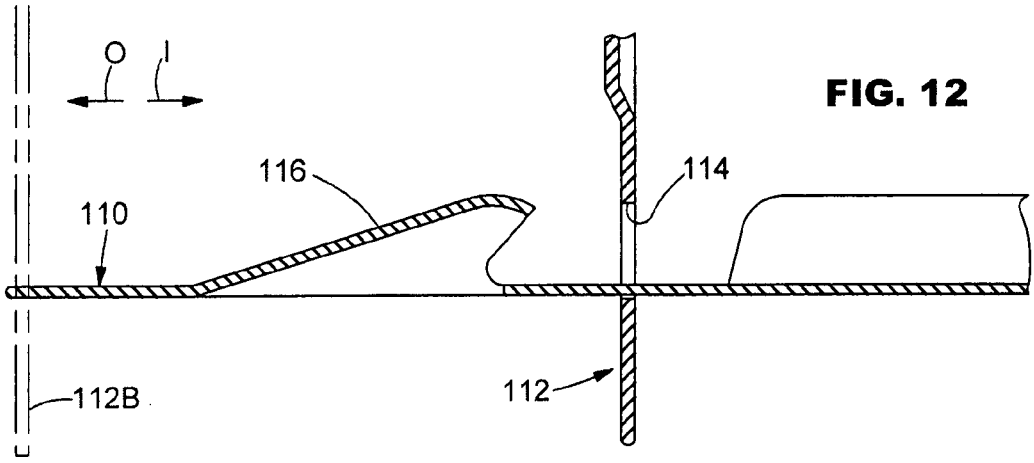
FIG. 12
FIG. 13
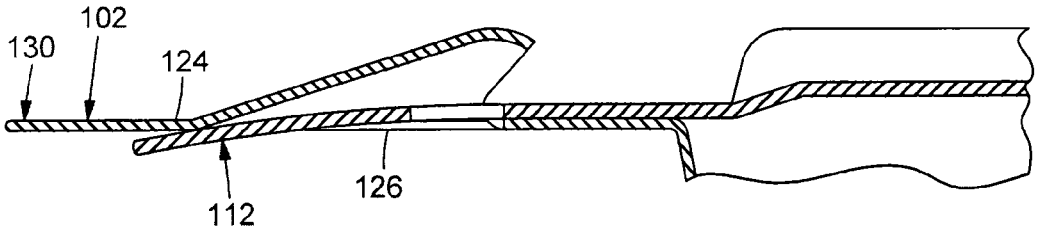
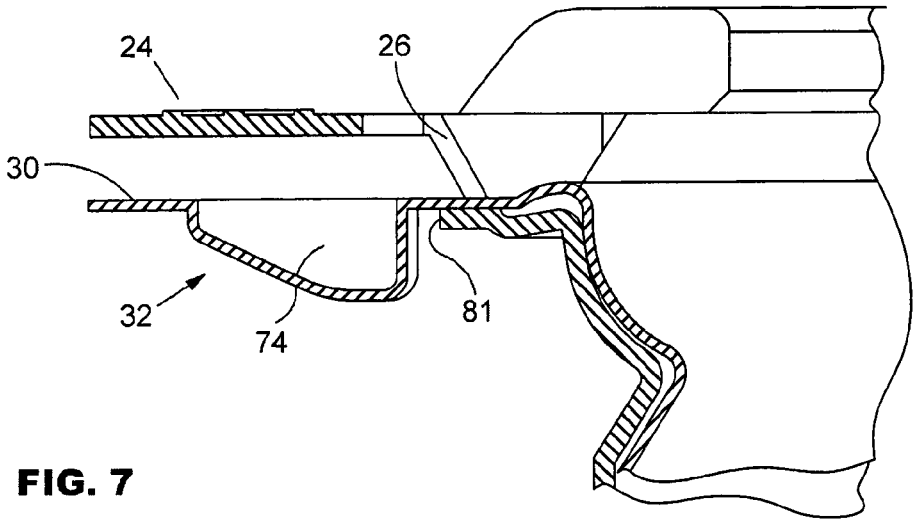
FIG. 7

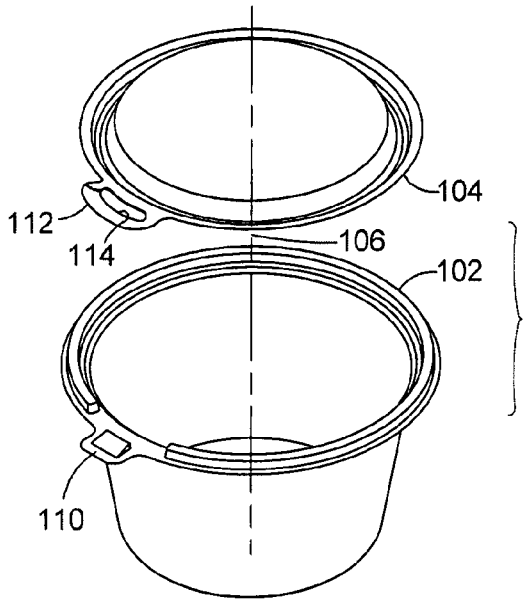
FIG. 8
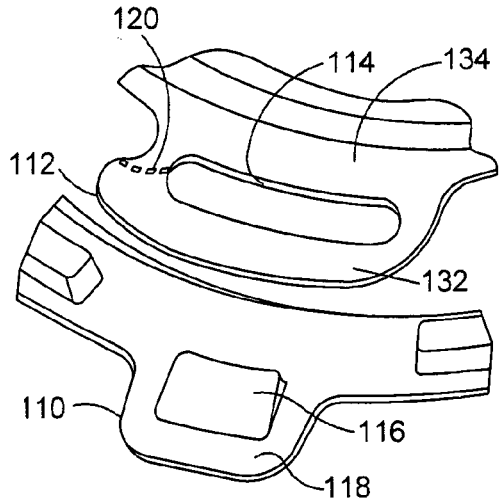
FIG. 9
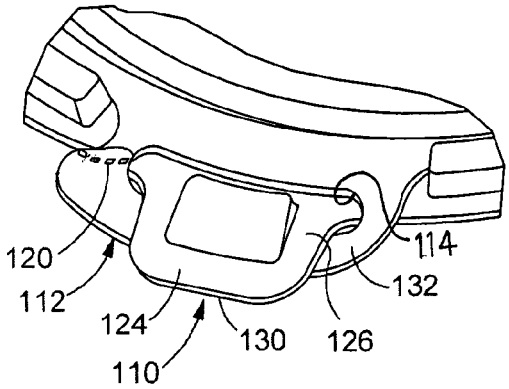
FIG. 10
FIG. 11
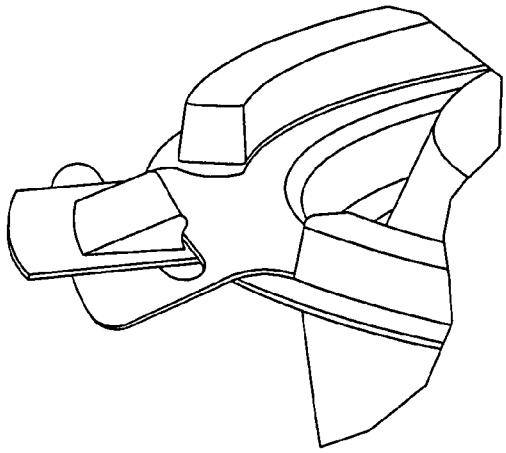

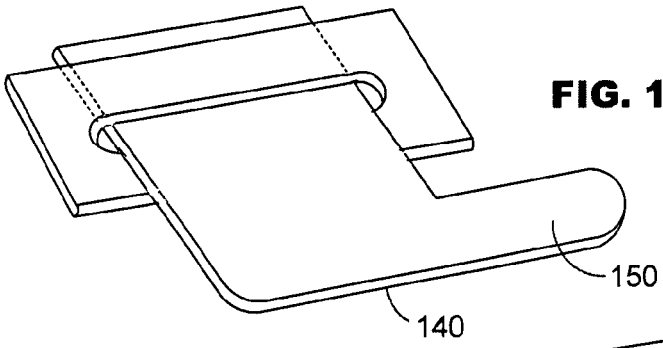
FIG. 14
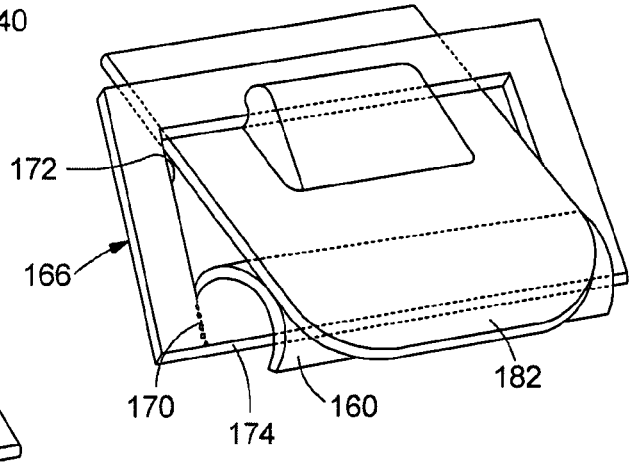
FIG. 17
FIG. 15
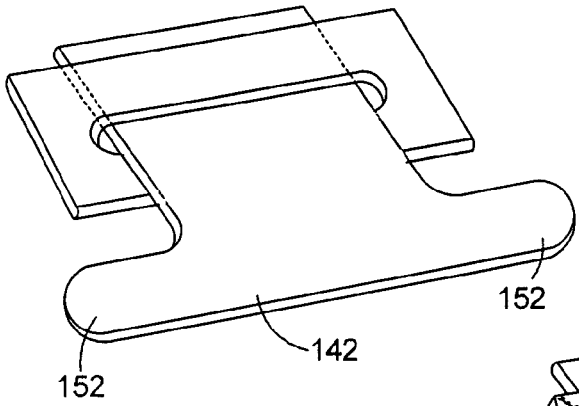
FIG. 18
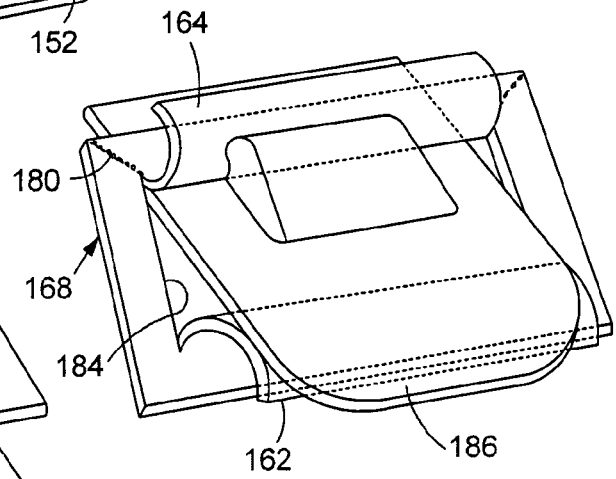
FIG. 16
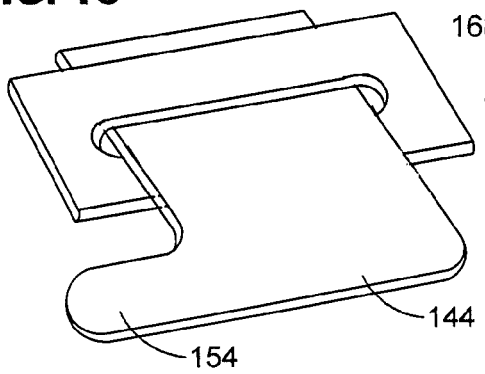

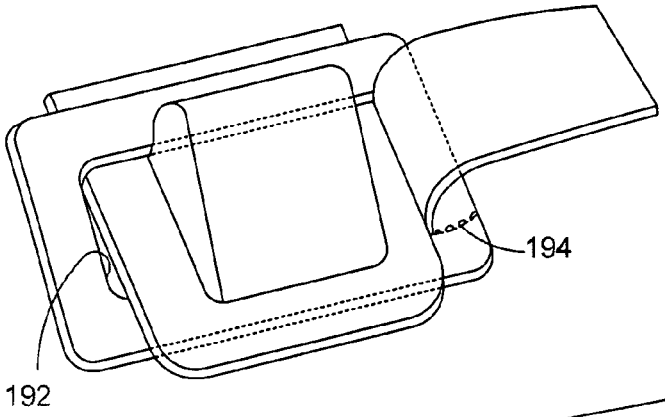
FIG. 19
FIG. 21
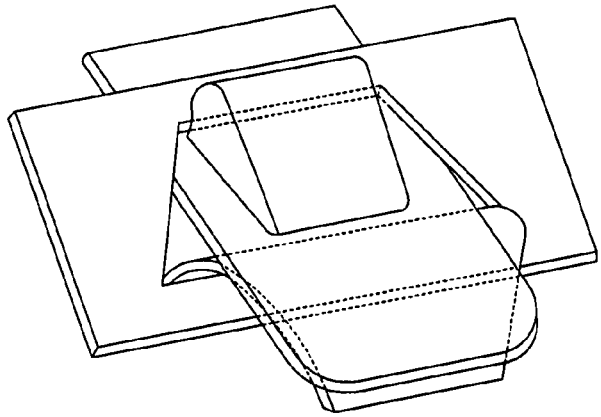
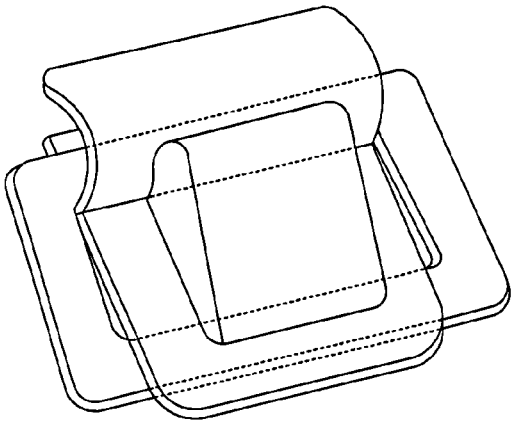
FIG. 22
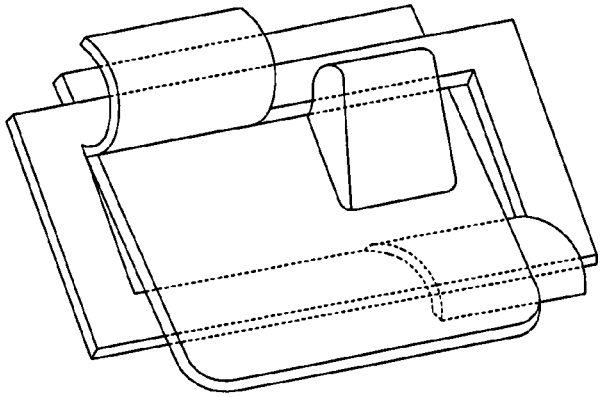
FIG. 20

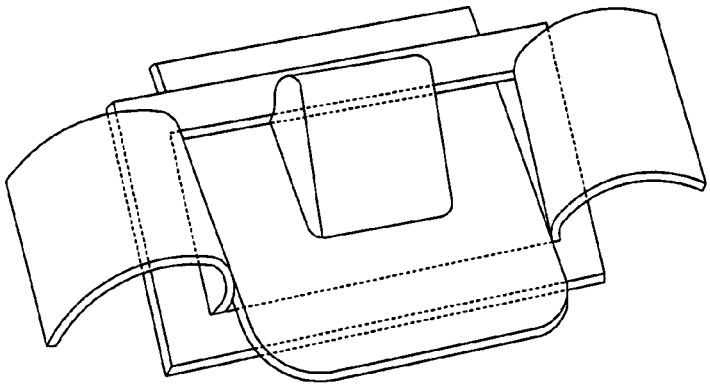
FIG. 23
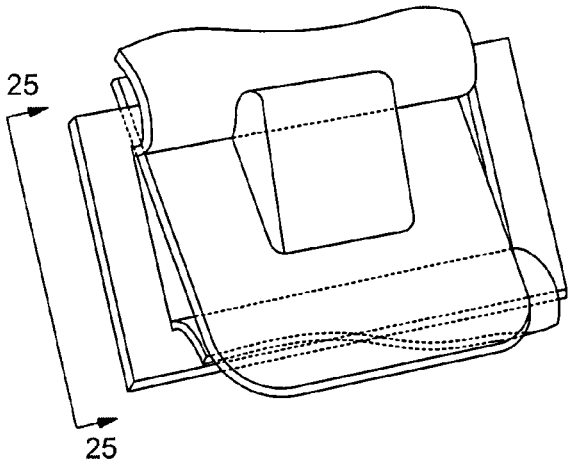
FIG. 24
FIG. 25
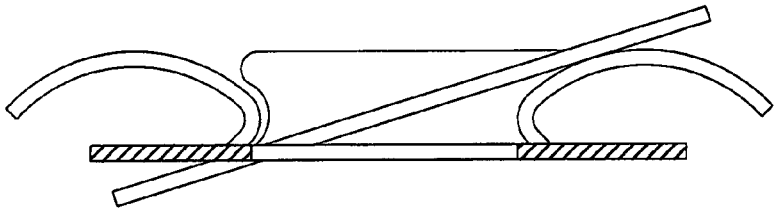

ADVANCED TAMPER EVIDENT BOWL

CROSS-REFERENCE

This is a continuation-in-part of U.S. patent application Ser. No. 11/315,654 filed Dec. 21, 2005.

BACKGROUND OF THE INVENTION

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of the food before closing it, and may have left germs in the food. A container that allowed a clerk at the store or at a distribution facility to automatically activate a device that clearly indicated to a potential customer whether or not the container has been opened since it was first closed by a clerk, would be of value.

SUMMARY OF THE INVENTION

In accordance with one embodiment of the present invention, a container is provided of the type that includes base and lid portions, or a base and lid. The container allows the lid to be closed and thereafter prevents the lid from being opened unless a part is ripped, torn, cut or otherwise severed to release the lid to be pulled up. The fact that the part was severed would be apparent and the fact that it was not assures customers that the container was not opened.

The container has an axis, and the lid and base each have tabs in an opening section of the container that occupies about 30° of the container periphery. One of the tabs has a slot and the other tab projects through the slot. The base tab forms a barrier that prevents the lid from lifting unless a portion of one of the tabs is severed, especially along a weakened or severable line that leads from the slot to the outside of the tab that forms the slot.

In one container the base tab forms a slot, and the lid tab extends through the slot to lie under the base tab. A severable line extends between the slot and a periphery of the tab. When a person tears the base tab along the severable line, the lid tab can be lifted through a gap in the base tab to open the container. Thereafter, when the lid is closed the lid tab lies on top of the base tab.

In another container, the lid tab forms a slot and the base tab projects through the lid slot. The lid tab has a sever line that can be torn to allow the lid tab to be lifted above the base tab to open the container.

The novel features of the invention are set forth with particularity in the appended claims. The invention will be best understood from the following description when read in conjunction with the accompanying drawings.

BRIEF DESCRIPTION OF THE DRAWINGS

FIG. 7 is a sectional view of the opening section of the container of FIG. 4 in a fully closed configuration.

FIG. 8 is an exploded isometric view of the base and lid of a container of another embodiment of the invention, wherein the lid tab has the slot.

FIG. 9 is an exploded isometric view of the opening section of the container of FIG. 8.

FIG. 10 is an isometric view showing the tabs of the opening section of the container of FIG. 9, fully engaged with each other.

FIG. 11 is another isometric view of the opening section of the container of FIG. 10.

FIG. 12 is a sectional view of the opening section of the container of FIG. 9, showing the manner in which the lid tab is installed on the base tab.

FIG. 13 is a sectional view similar to that of FIG. 12, after the lid tab has been fully installed on the base tab.

FIGS. 14 through 16 illustrate tabs of opening sections of containers, wherein the tab that extends through a slot has one or two peripherally-extending projections.

FIGS. 17 through 25 illustrate tabs of opening sections of containers wherein flaps are left after cutting one of the slots, with the flaps used to stabilize the connection of the tabs.

DESCRIPTION OF THE PREFERRED EMBODIMENT

Figure 1:
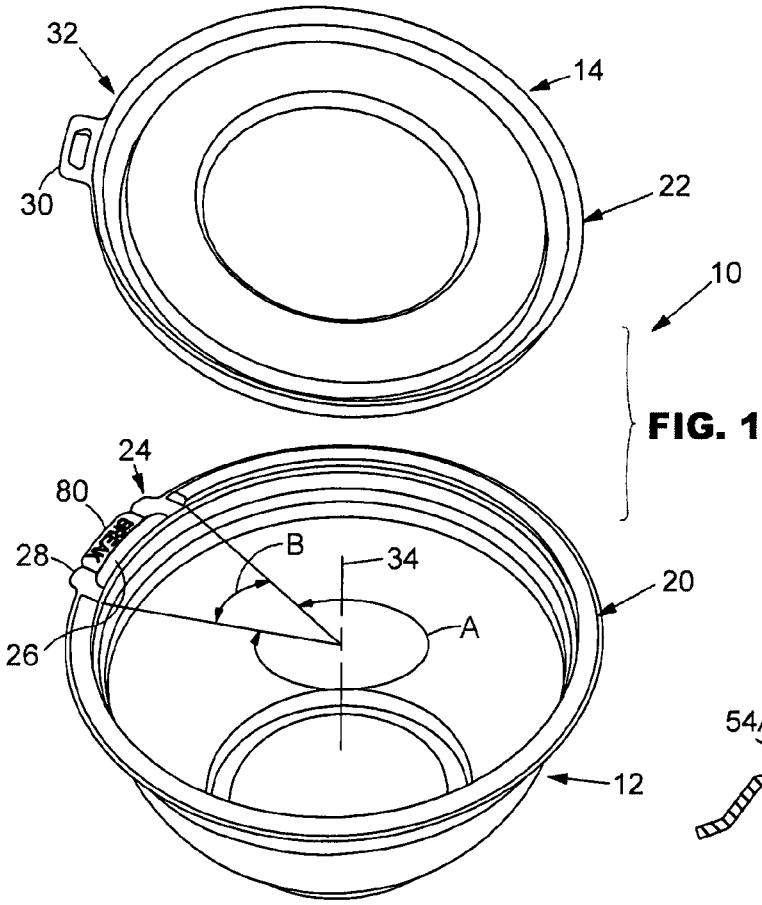
FIG. 1 is an exploded isometric view of the base and lid of a container of one embodiment of the invention.

FIG. 1 illustrates a container 10 of the invention which includes a base portion 12 and a lid portion 14, or base and lid. The base and lid can be part of a single sheet of plastic that forms a hinge, that connects the base and lid, or, as shown in FIG. 1 the base and lid can be separate elements with trapping sections 20, 22 that hold and seal them together until the lid is lifted off the base. The base and lid also have opening sections 24, 32 where they are held together until released by tearing.

The opening section 24 of the base has a base tab 28 that forms a slot 26 that receives a lid tab 30. The trapping sections 20, 22 of the base and lid (which occupy practically all of the container periphery except for the opening sections) extend along an angle A that is preferably at least 300° around the vertical axis 34 of the closed container. The opening sections 24, 32 of the base and lid extend by an angle B that is preferably less than 90° around the axis, such as about 30°.

Figure 5:
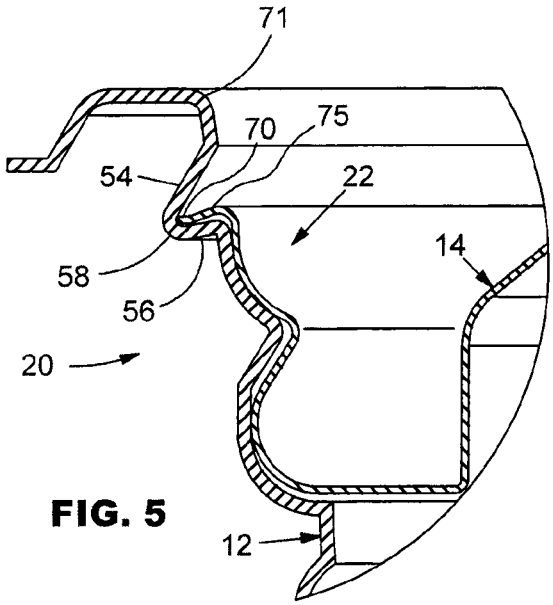
FIG. 5 is a sectional view of one construction of a trapping section of the container of FIG. 1 after the lid has been fully closed on the base.
Figure 2:
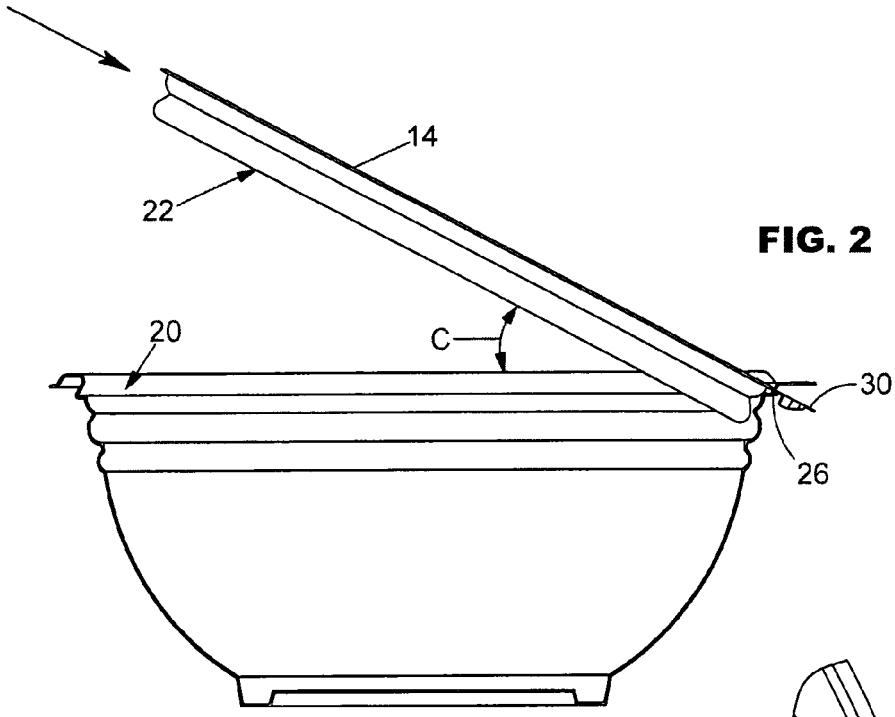
FIG. 2 is a sectional side view of the container of FIG. 1, showing the lid tab being inserted through a slot in the base tab in the course of closing the container.
Figure 3:
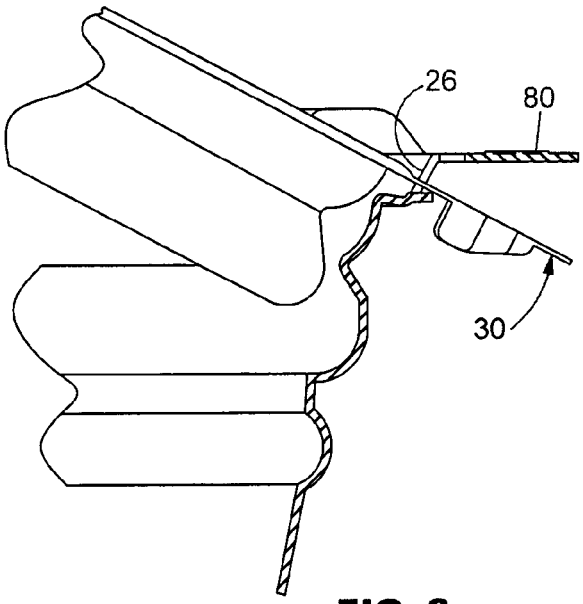
FIG. 3 is an enlarged sectional view of a portion of the container of FIG. 2.

The lid 14 is installed in the manner illustrated in FIG. 2, by holding the lid 14 at an incline C of perhaps 30° to the horizontal and to the top of the base, and projecting the lid tab 30 through the base slot 26. Then the trapping section 22 of the lid is pushed down forcefully into the trapping section 20 of the base. FIG. 5 shows the trapping sections 20, 22 of the base and lid in their fully trapped positions. The base has a trapping wall 54 that extends at a radially inward (with respect to the container axis) and upward incline, from the radially outward end of a stop wall 56 that preferably extends primarily horizontal (radial). The lid has a wall 75 with a peripheral lip 70 that rests at the inside of the intersection, or corner 58 of the trapping and stop walls 54, 56.

When the trapping section 22 of the lid is pushed down forcefully into the trapping section 20 of the base to the position of FIG. 5, the lip 70 initially bends up as it rides over a side wall 71 and begins to move down the trapping wall 54. The lip comes to rest at the inside of corner 58. The lip 70 strongly resists upward movement from the rest position of FIG. 5 because of the trapping wall.

Figure 6:
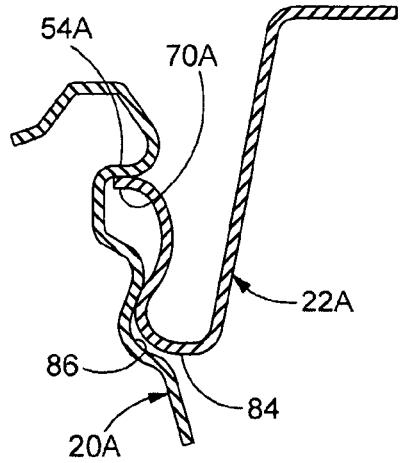
FIG. 6 is a sectional view of another construction of a trapping section of the container of FIG. 1 after the lid has been fully closed on the base.

FIG. 6 shows another form of trapping sections 20A and 22A, wherein the base has a trapping wall 54A that lies over a lid peripheral lip 70A. Sealing walls 84, 86 limit downward movement of the lid in the base. In both FIG. 5 and FIG. 6, the base trapping wall 54 or 54A lies over a peripheral lip of the lid to prevent easy lift-up of the trapping section 22 or 22A of the lid, so lift-up occurs only after the lid opening section 32 has been lifted.

FIG. 7 shows the opening sections 24, 32 of the base and lid when the lid has been fully closed on the base. The lid tab 30 projects primarily radially through the slot 26 formed in the opening section 24 of the base. The base tab has a barrier wall 80 that lies above the lid tab 30 to prevent the lid tab from being lifted. The lid tab has a primarily vertical projection 74 that stiffens the lid tab to prevent bending it to move it radially inward through the base slot 26, and to snag on the base edge 81 if such inward movement is attempted.

Figure 4:
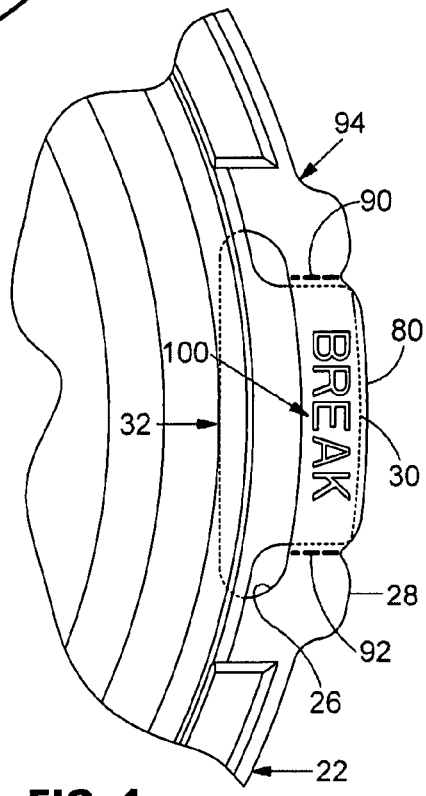
FIG. 4 is a plan view of the opening section of the container of FIG. 3 after the lid has been fully closed.

FIG. 4 shows that the barrier 80 formed by the base tab 28 is attached by two tear joints or sever lines 90, 92 to a major portion 94 of the base. The sever lines are weakened by perforations, notches or by a groove extending partway through the sheet at each sever line. The barrier 80 has an indication 100, formed by the word "BREAK" that indicates that the sever line or lines should be severed. Once a sever line has been broken, the lid can be repeatedly closed and opened using only moderate force, with the lid tab usually left above the base tab. In FIG. 4 the base tab 28 forms the slot 26 between itself and the major portion 94 of the base. The base tab can be made longer with the slot formed completely within such a base tab. It can be seen that the base tab 28 has a small radial length and greater circumferential length (with respect to the axis).

FIG. 8 illustrates another container 100 which includes lid and base portions, or a base and lid 102, 104 that lie on an axis 106 and that have tabs 110, 112, that can be latched in a closed position in a way similar to the container of FIGS. 1-7. In this container, the lid tab 112 forms a slot 114 that receives the base tab 110. FIG. 9 shows that the lid slot is formed between a lid radially outer tab wall 132 and another portion 134 of the lid (which may or may not be part of the lid tab). FIG. 9 also shows that the base tab 110 has a vertical projection 116 that projects upward from a surrounding portion 118 of the base tab. The lid tab has a sever line 120 that extends from the slot 114 to the periphery 122 of the lid tab. FIGS. 10 and 11 show the base tab projecting through the lid slot. To do this, the lid tab is positioned radially outward O of the base tab and moved radially inwardly I to receive the base tab.

FIG. 12 shows the lid tab at 112A oriented to extend vertically, and also shows the lid tab after it has been moved inward I from a position at 112B to the position 112A. The lid slot 114 receives the base tab 110, and has ridden over the projection 116, with a small interference requiring some bending. After achieving the position 112A, the lid is tilted to the horizontal position shown at 112 in FIG. 13. The lid tab 112 cannot be lifted because portions 124, 126 of a base tab barrier wall 130 are in the way. To lift the lid tab, a person tears the lid tab along sever line 120 (FIG. 10) of the lid tab, which extends from the slot 114 to the lid tab periphery 112. Then, radially outer tab wall 132 of the lid tab deflects downward and out of the way when the lid tab is lifted. Afterward, when the lid is reclosed the lid tab remains above the base tab.

A comparison of the tabs 24,32 of FIGS. 1-7 with the tabs 102, 112 of FIGS. 8-13 shows their similarities and differences. In FIG. 4 the base tab 28 is wider than the lid tab 30 so the base tab almost completely covers the lid tab, and the tear line 90 or 92 is in the base tab. In FIG. 10, the lid tab 112 is wider than the base tab 110 and the tear line 120 is in the lid tab at a location not covered by the base tab.

FIGS. 14-16 show opening sections of containers similar to that of FIGS. 8-13, with base tabs 140, 142 and 144 that have circumferentially-extending, or peripherally-extending projections 150, 152, 154 on their radially outer ends. The lid tab has to be guided carefully around these side projections during installation of the lid on the base. These projections prevent radially inward movement of the lid tab in an attempt to disconnect it from the base tab.

FIGS. 17 and 18 show opening sections of containers similar to those of FIGS. 8-13, but with tines 160, 162, 164 left in the lid tab 166, 168. Tine 160 in FIG. 17 leads to a weakened, or sever line 170 that leads from a slot 172 to a periphery 174 and can be torn by pulling on the tine 160. This allows the lid tab 186 to be raised above a base tab 182. Another tine 164 in FIG. 18 leads to a sever line 180 that leads from a slot 184 to a tab periphery and that can be severed by pulling on tine 164 to raise the lid tab above a base tab 186.

FIG. 19 shows a tine 190 that leads from a circumferential side of the slot 192 and that begins a sever line 194 leading from the slot to the tab periphery.

FIGS. 20-25 illustrate additional tine arrangements.

Thus, the invention provides a container with a lid and base (or lid and base "portions") having opening sections with lid and base tabs. One of the tabs forms a slot and the other tab extends largely horizontally through the slot. One of the tabs has a sever line, or tear line, that is weakened, and that preferably extends from the slot to the periphery of the tab that forms the slot. The base and lid also have trapping sections that extend around most of the container circumference, where the lid cannot be lifted or pivoted until the lid tab has been lifted.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container having a base and a lid formed of plastic sheeting which has been deformed, wherein:

the base and the lid are centered on a vertical axis and the base and the lid each has a trapping section and an opening section generally perpendicular to the vertical axis, the trapping section of the base having a trapping wall that allows the trapping section of the lid to be pushed down to an installed position and then resists the trapping section of the lid from being pulled up;

the opening section of the lid comprises a lid tab having a slot and an outer tab wall at the top of the slot;

the opening section of the base comprises a base tab that lies in the slot above said outer tab wall, wherein the lid tab cannot be pulled up without removing the outer tab wall from a location directly below the base tab;

the opening section of the lid further comprises at least one breakable joint line between an inner edge of the slot and a periphery of the outer tab wall, and removal of the outer tab wall from below the base tab requires breaking the joint line.

2. The container of claim 1, wherein the base tab further comprises a vertical projection.

3. The container of claim 1, wherein the base tab further comprises a side projection.

4. The container of claim 1, wherein the lid tab further comprises a tine, wherein the joint line is located between a first side of the tine and the periphery of the outer wall tab.

5. The container of claim 1, wherein the joint line can be broken by pulling on the tine.

* * * * *